US005662504A

United States Patent [19]

Krivec

[11] Patent Number: 5,662,504

[45] Date of Patent: Sep. 2, 1997

[54] SIDE TERMINAL ADAPTER

[75] Inventor: Bert Krivec, Waukesha, Wis.

[73] Assignee: Snap-on Technologies, Inc., Lincolnshire, Ill.

[21] Appl. No.: 459,482

[22] Filed: Jun. 2, 1995

[51] Int. Cl.[6] ..... H01R 4/30

[52] U.S. Cl. ..... 439/857; 439/755

[58] Field of Search ..... 439/857, 859, 439/868, 883, 755

[56] References Cited

U.S. PATENT DOCUMENTS

| | | | |
|---|---|---|---|
| 1,847,689 | 3/1932 | Gribbie . | |
| 1,874,593 | 8/1932 | Olson . | |
| 1,921,823 | 8/1933 | Hosking | 439/883 |
| 2,724,815 | 11/1955 | Sisco . | |
| 3,945,709 | 3/1976 | Filson . | |
| 4,345,807 | 8/1982 | Shekel et al. . | |
| 4,377,317 | 3/1983 | Shekel et al. . | |
| 4,565,414 | 1/1986 | French . | |
| 4,620,767 | 11/1986 | Woolf . | |
| 4,775,337 | 10/1988 | Van Wagener et al. . | |
| 4,923,415 | 5/1990 | Lee . | |
| 4,932,896 | 6/1990 | Julian . | |
| 4,936,640 | 6/1990 | Pratzer . | |
| 5,026,307 | 6/1991 | Lee . | |
| 5,108,320 | 4/1992 | Kimber . | |

*Primary Examiner*—Neil Abrams
*Assistant Examiner*—Eugene G. Byrd
*Attorney, Agent, or Firm*—Emrich & Dithmar

[57] ABSTRACT

An improved elongated side terminal adapter is of the type for use with a jumper cable clamp. The terminal adapter includes a clamp connecting portion mateably engageable with the jumper cable clamp and a terminal connecting portion having laterally opposing terminal gripping plates disposed substantially in a common plane and cooperating to define an opening therebetween. The gripping plates are laterally resiliently deflectable to facilitate sliding the side terminal adapter onto a side terminal of a battery. A number of terminal engaging prongs bent out of the plane in a first direction and a number of terminal engaging prongs bent out of the plane in a second direction opposite to the first direction are disposed along the opening and are cooperatively arranged to define at least one terminal-receiving slot to facilitate clipping onto the battery side terminal.

19 Claims, 2 Drawing Sheets

SIDE TERMINAL ADAPTER

BACKGROUND OF THE INVENTION

1. Field of the Invention

This invention relates to connectors for battery booster cables of the type which can be used with side terminal batteries.

2. Description of the Prior Art

In recent years, many automobile manufacturers have changed from using batteries with top terminals to using batteries with side terminals, with the result that both types of batteries are now in use. Batteries with side mounted terminals, when set in an engine compartment, are normally set very close to other component parts so as to minimize space consumption or for other related reasons. Conventional booster cable clamps are either not very convenient for use to clamp, or cannot be clamped at all, onto side mounted battery terminals when the battery is set in the engine compartment, usually below the fender.

A number of side terminal adapters have been proposed to deal with this problem. U.S. Pat. No. 4,923,415 to Lee discloses a conductive charging clip which is set along an inclined sliding way on one of the two clamping jaw elements constituting a jumper cable clamp. The charging clip can be conveniently pulled out for operation or retracted back to be received inside the jaw element. The clip is essentially a flat conducting clamp having an opening at a middle part thereof, defining two gripping plates each with recesses of various sizes formed along the inside surface of the gripping plates and aligned so as to cooperate in pairs along the length of the opening. In the patented construction, the clip is provided with two terminal-receiving slots defined by the communicating pairs of holes formed on the gripping plates, each slot accommodating a specific size terminal. During a charging operation, the clip is pulled out from the jaw element and the clip slid into engagement over, for example, one of two protruding side mounted terminals on the battery. As the terminal engages the front end of the clip, the clip yields outwardly at the opening to receive the terminal in an appropriate one of the two terminal-receiving slots.

For best electrical connection the terminal should be locked within the slot when engaged therewith. However, because the construction of the slots in the Lee patent is such as to circularly encase the terminal, the latter being generally of circular cylindrical construction and threaded, there is significant slippage of the clip relative to the clamp, thus permitting the clip to become separated from the terminal, or alternatively, to slip about the terminal into a position providing insufficient electrical conduction.

The Lee type clip is further disadvantageous as it is mounted to the jumper cable clamp in a very complicated manner, such as by way of tension springs and the like, providing retractable movement of the clip in only one direction, i.e., extending longitudinally with respect to the jumper cable clamp. It would be a further advancement in the art to provide a clip or side terminal adapter which can be coupled easily to a jumper cable clamp, either in a temporary or permanent manner, and which side terminal adapter can be optionally selected to project from the clamp in a non-longitudinal manner to facilitate sliding the adapter vertically over the battery terminal.

SUMMARY OF THE INVENTION

It is a general object of the present invention to provide a side terminal adapter for use with a jumper cable clamp which is economical and easy to manufacture.

It is another object of the present invention to provide a side terminal adapter which can be held securely along one end thereof—in either a temporary or permanent manner—by a jumper cable clamp, with an opposite end thereof including at least one terminal-connecting slot having prongs bent in a manner securely locking the adapter onto a battery terminal and insuring minimal slippage therebetween.

These and other features of the present invention are attained by providing an improved elongated side terminal adapter of the type for use with a jumper cable clamp. The terminal adapter includes a clamp connecting portion mateably engageable with the jumper cable clamp and a terminal connecting portion having laterally opposing terminal gripping plates disposed substantially in a common plane and cooperating to define an opening therebetween. The gripping plates are laterally resiliently deflectable to facilitate sliding the side terminal adapter onto a side terminal of a battery. A number of terminal engaging prongs bent out of the plane in a first direction and a number of terminal engaging prongs bent out of the plane in a second direction opposite to the first direction are disposed along the opening and are cooperatively arranged to define at least one terminal-receiving slot to facilitate clipping onto the battery side terminal.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
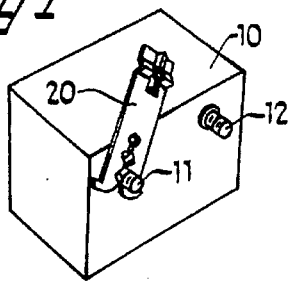
FIG. 1 is a perspective view of the side terminal adapter of the present invention shown clipped to a side mounted battery terminal.
Figure 4:
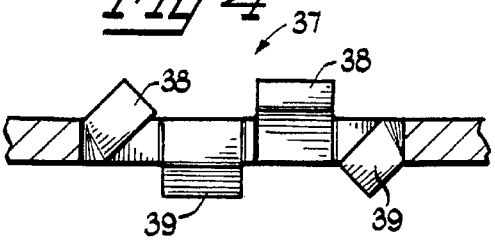
FIG. 4 is an enlarged, fragmentary, cross-sectional view, taken generally along the line 4—4 in FIG. 3.
Figure 5:
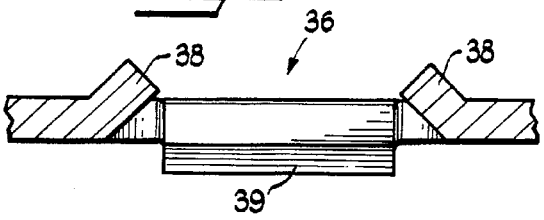
FIG. 5 is an enlarged, fragmentary, cross-sectional view, taken generally along the line 5—5 in FIG. 3.
Figure 2:
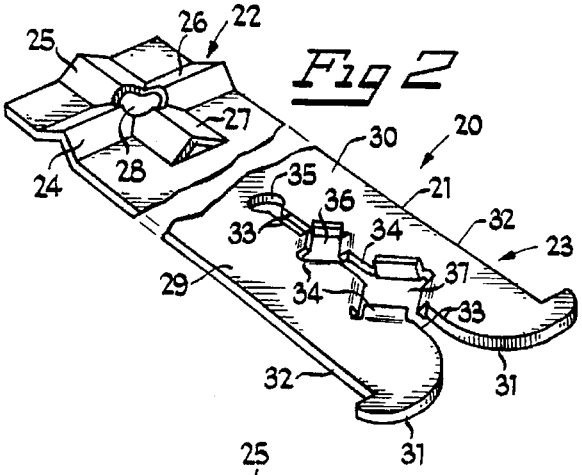
FIG. 2 is an enlarged perspective view of the terminal adapter of FIG. 1.

Referring to FIG. 1, there is illustrated a battery 10 having side mounted terminals 11, 12, on which terminal 11 is clipped an elongated side terminal adapter 20 constructed in accordance with and embodying the features of the present invention.

The side terminal adapter 20, shown more clearly in FIG. 2–7, consists of an elongated, substantially flat, plate-like member 21 having a clamp connecting portion 22 at one end and a terminal connecting portion 23 at the opposite end. The clamp connecting portion 22 includes four raised regions 24–27 disposed equidistantly about a central aperture 28. While in the preferred embodiment, the raised regions 24–27 are shown V-shaped, other shapes, including serrations, may be provided instead.

The terminal connecting portion 23 is bifurcated to define two spaced-apart, resiliently spreadable gripping plates 29, 30. The facing inner surfaces of the plates 29, 30 are configured to serve different functions. Surfaces 31 serve to receive the desired portion of the side terminal 11 and taper inwardly to create a wedging action which facilitates the resilient spreading of the plates 29, 30 during contact with the terminal 11 and guide the terminal between the plates 29, 30. The surfaces 31 taper outwardly a fixed distance beyond outside gripping surfaces 32 of the plates 29, 30 to define stopper tabs 32*a* for preventing a user's fingers from sliding forwardly during a manual sliding of the adapter 20 onto, for example, the terminal 11.

Surfaces 33 form a slotted opening 34 communicating at an inner end thereof with a hole 35 which facilitates spreading of the plates 29, 30. The slotted opening 34 includes two square-shaped terminal-receiving slots 36, 37 of different size for resiliently engaging therein battery terminals of different sizes. Terminal-receiving slot 36 is located nearest to hole 35, while slot 37 is located closest to the surfaces 31. Slots 36 and 37 are defined by a plurality of prongs or teeth, half of which, generally designated by the numeral 38, are bent out of the plane of the adapter 20 in one direction, and the other half of which designated by the numeral 39 are bent out of the same plane in the opposite direction (see FIGS. 4–5). In the illustrated embodiment, square-shaped slot 36 is smaller in cross-sectional width than is slot 37 and is defined by eight prongs, with one of prongs 38 and one of prongs 39 disposed adjacent to each other on each of the four sides of the slot, in alternating fashion. Square-shaped slot 37 is provided with only four prongs, one on each side of the square shape of the slot 37, with alternating prongs 38 and 39. The prongs 38, 39 serve to retain the adapter 20 in an engaged position—but also in a position insuring proper electrical contact—on a battery terminal of appropriate size.

To engage a battery terminal in one of the slots 36, 37, the terminal is received within opening 34, resiliently spreading gripping plates 29, 30 apart and becoming trapped in one of the slots. The cross-sectional diameter of the terminal must be slightly larger than the width of the slot to insure a tight, resilient fit. Of course, any attempt to engage too large a terminal with an adapter slot 36 or 37 may permanently deform the gripping plates.

Figure 6:
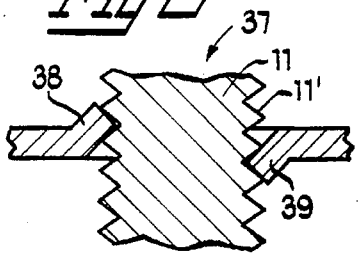
FIG. 6 is a reduced, fragmentary, cross-sectional view, similar to that in FIG. 4, showing a small diameter battery terminal disposed within the innermost terminal-receiving slot.
Figure 3:
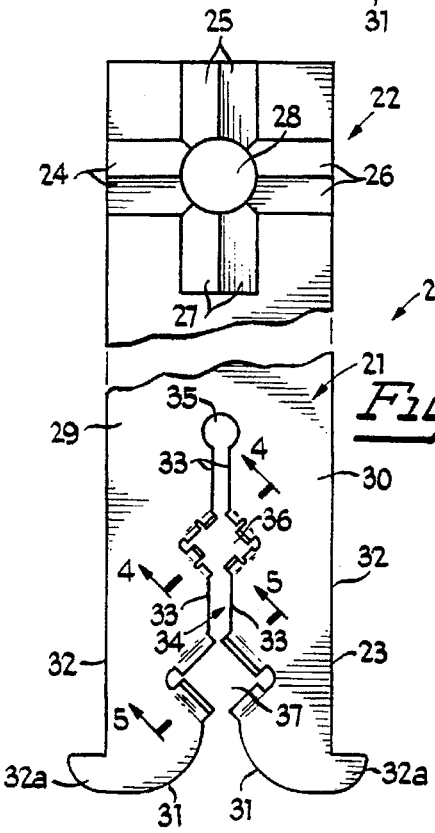
FIG. 3 is a further enlarged top plan view of the terminal adapter of FIG. 1.
Figure 7:
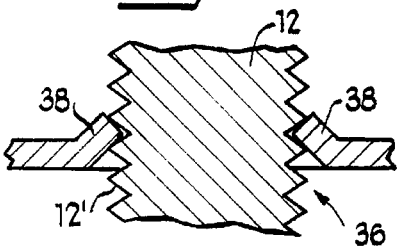
FIG. 7 is a reduced, fragmentary, cross-sectional view, similar to that in FIG. 5, showing a large diameter battery terminal disposed within the outermost terminal-receiving slot.

Referring now to FIG. 6, a battery terminal 11 of generally cylindrical shape and having a threaded circumferential surface 11', is shown engaged within the slot 36 having eight prongs, with associated opposite prongs 38 and 39 being matingly positioned in the valleys of the terminal's threads. In the same manner, FIG. 7 shows a battery terminal 12 of large cross-sectional diameter and having a threaded circumferential surface 12', engaged within the other slot 37 having four prongs and a larger square-shaped opening. It should be appreciated that the prongs 38, 39 are bent in a manner sufficient to provide firm engagement and minimal slippage between the clipped terminal adapter 20 and the terminal 11 (12).

Referring now to FIGS. 8–11, there will be explained the coupling of the terminal adapter 20 to a jumper cable clamp 50. The jumper cable clamp 50 comprises two gripping members 51, 52 hingedly connected at pin 53 and biased by a spring (not shown) into the closed state which is shown. One of the gripping members 51, 52 is suitably connected to an electrical conductor such as a cable (not shown) and it is usually desirable to insulate the gripper members at least rearwardly of the pivot pin 53 to prevent shocks to the user.

Figure 8:
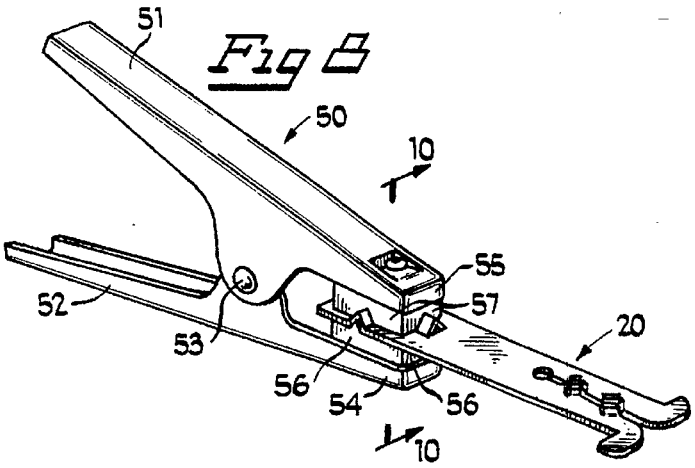
FIG. 8 is a perspective view of the side terminal adapter of FIG. 2 shown clamped to a jumper cable clamp and extending longitudinally therefrom.
Figure 9:
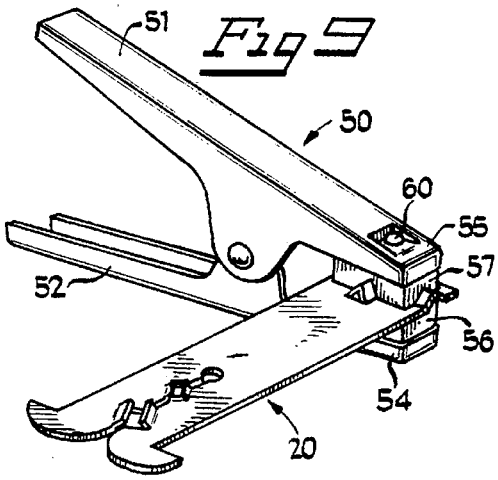
FIG. 9 is a view similar to that in FIG. 8, but showing the side terminal adapter clamped in a non-longitudinal manner with respect to the jumper cable clamp.

The front end portions 54, 55 of gripping members 52, 51 are separable when a manual force is applied to the members 52, 51 rearwardly of pin 53 and are configured to have associated teeth 56, 57 on the inner faces thereof to form jaws for gripping a battery terminal therebetween. In the present embodiment, the clamp 50 is intended to be coupled to the clamp connecting portion 22 of side terminal adapter 20. In this regard, two conditions are possible. FIG. 8 shows the terminal adapter 20 connected extending longitudinally outwardly from the gripping jaws of the clamp 50. FIG. 9 shows an alternative coupling connection with the terminal adapter 20 extending laterally from one side of the gripping jaws of clamp 50. It should be appreciated that the adapter 20 could just as easily could have been engaged to extend from the opposite side of the clamp gripping jaws, in lateral or non-longitudinal fashion.

Once the adapter 20 is engaged between the clamp gripping jaws it is held gripped therebetween by the normal spring bias of the clamp 50. Removing the adapter 20 from the clamp's gripping jaws is effected by compressing the opposite ends of gripping members 51, 52 to open the jaws. When the clamp jaws grip the clamp connecting portion 22, the V-shaped regions 24–27 mateably engage between associated ones of teeth 56, 57 on end portions 54, 55. In this regard, teeth 56, 57 have like V-shaped indentations formed therebetween to facilitate mating engagement with the adapter 20, in either longitudinal or lateral extending manner (see FIGS. 8, 9).

Figure 10:
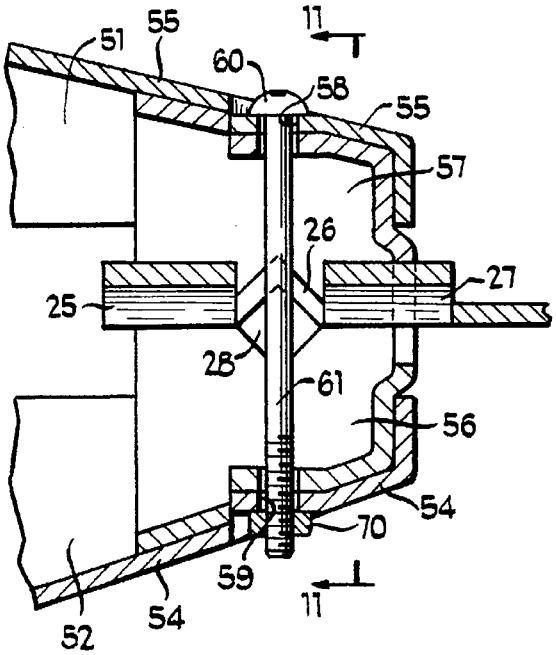
FIG. 10 is an enlarged, fragmentary, vertical sectional view taken generally along the line in 10—10 in FIG. 8.

To protect against inadvertent release of the adapter 20 from the clamp jaws, it is possible to provide a more permanent coupling arrangement, the details of which will be explained with respect to FIGS. 10-11.

Figure 11:
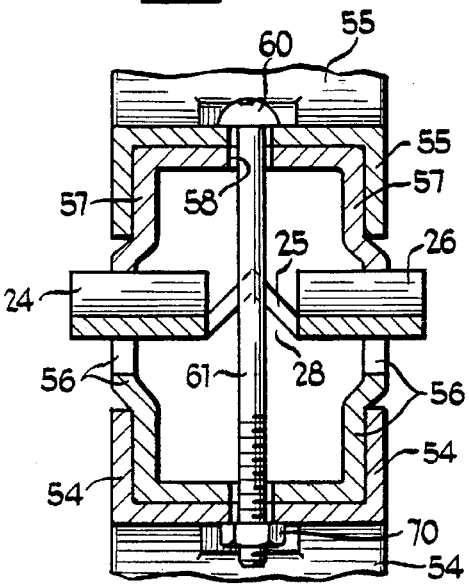
FIG. 11 is a vertical sectional view taken generally along the line 11—11 in FIG. 10.

Referring to FIG. 11, end portions 54 and 55 are provided with screw-receiving throughbores 59, 58, respectively, serving as a means for receiving the shank 61 of a screw 60 therethrough. The head of screw 60 rests on the outer surface of end portion 55. The screw shank 61 extends across the whole vertical length of the closed clamp gripping jaws projecting through the aperture 28 on the clamp connecting portion 22 of adapter 20 and outwardly from throughbores 59. The screw 60 is then threadedly engaged with a nut 70 and tightened to a predetermined tension against the outer surface of end portion 54, to provide a permanent coupling connection and insure against pivotal or other movement of the adapter 20 relative to the clamp 50 while clipping its terminal connecting portion 23 to a battery terminal, such as terminal 11.

The clamp 50 and adapter 20 may be formed of a suitable metal or other electrically conductive material. The dimensions of the slots as well as the number of prongs to use can be variable and is to some degree based upon manufacturer's specifications for the side battery terminals.

It should be readily appreciated that the side terminal adapter 20 of the present invention could be used without modification on batteries having top terminals, but is most advantageous on side battery terminals where access to the terminals is difficult in modern day engine compartments.

In the preferred embodiment, the adapter 20 is shown provided with both upwardly and downwardly extending prongs cooperatively arranged in polygonal-fashion around a battery terminal to function as an effective means for preventing the inadvertent disengaging or slipping of the adapter 20 from the terminal. However, it should be appreciated that prongs 38, 39 may extend, together or separately, in any number of different non-planar directions and/or arranged in any number of polygonal or other shapes without departing from the scope of the invention.

While particular embodiments and several specific forms of tools of the present invention have been shown and described, it will be appreciated by those skilled in the art that additional changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered byway of illustration only and not as a limitation. The actual scope of the invention is intended to be defined in the following claims when viewed in their proper perspective based on the prior art.

We claim:

1. An elongated side terminal adapter for use with a jumper cable clamp, comprising:

a clamp connecting portion mateably engageable with the jumper cable clamp; and a terminal connecting portion having laterally opposing terminal gripping plates disposed substantially in a common plane and cooperating to define an opening therebetween, said plates being laterally resiliently deflectable to facilitate sliding said side terminal adapter onto a side terminal of a battery and including a first plurality of terminal engaging prongs bent out of said plane in a first direction and a second plurality of terminal engaging prongs bent out of said plane in a second direction opposite to the first direction, said first and second pluralities of prongs being disposed along said opening and cooperatively arranged to completely define at least one terminal-receiving slot having oppositely facing substantially straight sides to facilitate clipping onto the battery side terminal, with each of said first and second pluralities of prongs including prongs respectively disposed along said oppositely facing sides of the at least one slot.

2. The adapter of claim 1, wherein the prongs defining said at least one terminal-receiving slot are arranged to define a square-shaped opening.

3. The adapter of claim 2, wherein the prongs defining said square-shaped opening are arranged such that one set of oppositely facing sides of said square-shaped opening include prongs of said first plurality of prongs, and the other set of oppositely facing sides of said square-shaped opening include prongs of said second plurality of prongs.

4. The adapter of claim 2, wherein the prongs defining said square-shaped opening are arranged such that each side of said square-shaped opening includes two prongs, one from each of said first and second pluralities of prongs, there being a total of eight prongs alternately from said first and second pluralities.

5. The adapter of claim 1, wherein said jumper cable clamp includes longitudinally extending and movably opposing clamping jaws, each clamping jaw having teeth communicating with associated teeth on the opposing jaw, said clamp connecting portion including a plurality of raised regions sized and shaped for mating engagement with the clamping jaws of the clamp for clamping said side terminal adapter to the clamp.

6. The adapter of claim 5, wherein said regions are V-shaped and are arranged such that said side terminal adapter can be clamped in a non-longitudinally extending manner relative to the clamp.

7. The adapter of claim 5, wherein said clamp connecting portion includes means to facilitate permanently connecting said side terminal adapter to the clamp.

8. The adapter of claim 7, wherein said means for facilitating permanently connecting said side terminal adapter includes a screw-receiving hole disposed through said V-shaped regions.

9. The adapter of claim 1, wherein said prongs define two terminal-receiving slots with differing size polygonal-shaped openings.

10. The adapter of claim 9, wherein said polygonal-shaped openings are square-shaped openings.

11. An elongated side terminal adapter for use with a jumper cable clamp, comprising:

a clamp connecting portion mateably engageable with the jumper cable clamp; and a terminal connecting portion having laterally opposing terminal gripping plates disposed substantially in a common plane and cooperating to define an opening therebetween, said plates being laterally resiliently deflectable to facilitate sliding said side terminal adapter onto a side terminal of a battery and including a plurality of terminal engaging prongs bent out of said plane in at least one direction, said plurality of terminal engaging prongs being disposed along said opening and cooperatively arranged to completely define at least one terminal-receiving slot defining a square-shaped opening to facilitate clipping onto the battery side terminal, the prongs defining said at least one terminal-receiving slot being arranged to define a slot with at least one prong disposed along each side of the square.

12. The adapter of claim 11, wherein the prongs defining said square-shaped opening are arranged such that one set of oppositely facing sides of said square-shaped opening include prongs bent out of said plane in a first direction, and the other set of oppositely facing sides of said square-shaped opening include prongs bent out of said plane in a second direction opposite the first direction.

13. The adapter of claim 11, wherein the prongs defining said square-shaped opening are arranged such that each side of said square-shaped opening includes two of said prongs, one bent out of said plane in a first direction and one bent out of said plane in a second direction opposite the first direction, there being a total of eight prongs alternately from the prongs bent in the first and second directions.

14. The adapter of claim 11, wherein said jumper cable clamp includes longitudinally extending and movably opposing clamping jaws, each clamping jaw having teeth communicating with associated teeth on the opposing jaw, said clamp connecting portion including a plurality of raised regions sized and shaped for mating pivotal connection with the clamping jaws of the clamp for clamping said side terminal adapter to the clamp.

15. The adapter of claim 14, wherein said a regions are V-shaped and are arranged such that said side terminal adapter can be clamped in a non-longitudinally extending manner relative to the clamp.

16. The adapter of claim 14, wherein said clamp connecting portion includes means to facilitate permanently connecting said side terminal adapter to the clamp.

17. The adapter of claim 11, wherein said adapter is a substantially flat, plate-like member.

18. The adapter of claim 11, wherein said prongs define two terminal-receiving slots with differing size polygonal-shaped openings.

19. The adapter of claim 18, wherein said polygonal-shaped openings are square-shaped openings.

* * * * *